United States Patent [19]

Vance

[11] 4,011,657

[45] Mar. 15, 1977

[54] KNIFE

[76] Inventor: Larry F. Vance, Box 447, Pinedale, Wyo. 82941

[22] Filed: Nov. 21, 1975

[21] Appl. No.: 634,228

[52] U.S. Cl. ..... 30/337; 279/77

[51] Int. Cl.[2] ..... B26B 5/00

[58] Field of Search ..... 30/329, 335, 336, 339, 30/342, 337; 276/76, 77, 79

[56] References Cited

UNITED STATES PATENTS

| | | | |
|---|---|---|---|
| 300,356 | 6/1884 | Gardner | 279/76 |
| 324,563 | 8/1885 | Koska | 279/77 |
| 1,013,844 | 1/1912 | Owens | 30/335 X |
| 1,998,188 | 4/1935 | Dunn | 279/77 |
| 2,439,071 | 4/1948 | Basham | 279/77 |
| 3,711,950 | 1/1973 | Students | 30/341 |

*Primary Examiner*—Al Lawrence Smith
*Assistant Examiner*—J. C. Peters
*Attorney, Agent, or Firm*—H. Ross Workman; J. Winslow Young

[57] ABSTRACT

A knife having a handle adapted to interchangeably receive in releasable interlocking relationship a variety of blade configurations. Each blade includes an arcuate tang dimensionally adapted to be telescopically received in a mating arcuate slot in the handle. Included in the handle are locking devices for releasably engaging the tank in the slot.

9 Claims, 8 Drawing Figures

KNIFE

BACKGROUND

1. Field of the Invention

This invention relates to a knife having an interchangeable blade.

2. The Prior Art

The knife is a very useful tool and is used by sportsmen, workers, pilots, etc. for a variety of purposes. Specifically, each user prefers a specialized knife blade for each task to be performed. Accordingly, a variety of knife blades are readily available including, for example, a skinning blade, a chopping blade, a linoleum blade, a pruning blade, a hatchet blade, a saw blade, a fisherman's blade, a tool blade, and the like. Each blade generally requires a separate handle which is permanently attached thereto.

Although the blades are of different configurations, the handles are generally the same configuration. Each handle, therefore, represents a significant portion of the weight and bulk of each different type of knife. Furthermore, persons accustomed to frequent and long-term usage of a knife overwhelmingly prefer that the particular knife handle be customized to fit the person's hand. The person desiring a variety of blades must, therefore, meet an unnecessary expense in (1) obtaining a customized handle for (2) a variety of blade types. Moreover, the person selling the various knives must inventory a large number of blade types, each with a variety of different handle types to accommodate the particular preferences of the individual buyers.

One prior art patent, U.S. Pat. No. 3,900,950, relates to a knife having a removable blade wherein the blade includes a tang insertable into the handle. A cam lock recess on the tang receives a cam lock protrusion on a lever lock. Some of the problems associated with this particular configuration include (1) gradual loosening of the blade with respect to the handle during usage and (2) the accumulation of dirt and debris in the tang receiving area of the handle.

In view of the foregoing what is needed is a knife having a removable blade wherein the normal working forces exerted on the blade tend to more tightly secure the blade to the handle. It would also be an advantageous feature to provide a knife with a removable blade wherein the locking mechanism can be selectively configurated so as to tighten the blade into the handle upon locking. A further advantageous feature would be one wherein the tang receiving slot is open to the exterior of the knife blade to avoid the problem of debris accumulation in the tang slot. Such an invention is disclosed herein.

BRIEF SUMMARY AND OBJECTS OF THE INVENTION

The present invention includes a novel knife with a removable blade and which advantageously utilizes the normal working forces exerted upon the knife blade to more securely seat the tang of the knife blade in the handle. Locking devices are also included which releasably engage the tang of the knife blade in the handle. The method of this invention also includes a method whereby debris may be easily cleared from the tang receiving slot in the handle.

It is therefore an object of this invention to provide improvements in a knife having a removable blade.

Another object of this invention is to provide a knife having a removable blade wherein the normal working forces exerted on the blade more securely tighten the blade tang with respect to the handle.

An even further object of this invention is to provide an improved method for engaging a removable blade with a handle.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

General

The knife of this invention includes a handle which receives a curved tang of a blade in releasable interlocking relationship. The tang is received in a matching curved slot in the handle. Preferentially, the slot extends arcuately through the handle to an opening along one side of the handle so that dirt and other debris will be forced therefrom each time the curved tang is inserted into the curved slot.

The curved tang on the blade and the matching curved slot in the handle are configurated so that normal working pressures exerted against the blade tend to force the tang deeper into the slot thereby providing a more secure engagement between the blade and the handle. Reverse pressure on the back of the blade tends to dislodge and remove the curved tang from its slot. Various devices for releasably interlocking the curved tang with the handle are set forth in the embodiments illustrated in FIGS. 2–7 with parts of the figures broken away for ease of illustration and explanation.

Advantageously, the curved tang also helps hold the blade in the handle when pulling forces are exerted longitudinally thereon, for example, when the handle is used with a saw blade, hatchet blade, etc. A straight tang, on the other hand, would tend to pull from the slot under such forces.

The handle shown throughout is shown as a relatively plain handle, however, various handle configurations may readily be used with the advantages of the interchangeable blades of this invention. For example, the handle may be custom fit to the individual hand contour of the buyer without interfering with novel tang and tang engaging features of this invention.

The base of the blade is, preferentially, received in a keyway in the forward end of the handle so as to more securely engage the blade in the handle against lateral forces. Importantly, normal working forces are exerted upon the blade tang tending to drive it more deeply into the slot in the handle thereby significantly alleviating the need for increased strength in the various tang locking devices. Furthermore, pulling forces imposed longitudinally along the axis of the handle are transmitted against the inner curved surface of the tang which, accordingly, provides a very strong resistance to dislodgement of the blade from the handle.

THE EMBODIMENT OF FIG. 1

Figure 1:
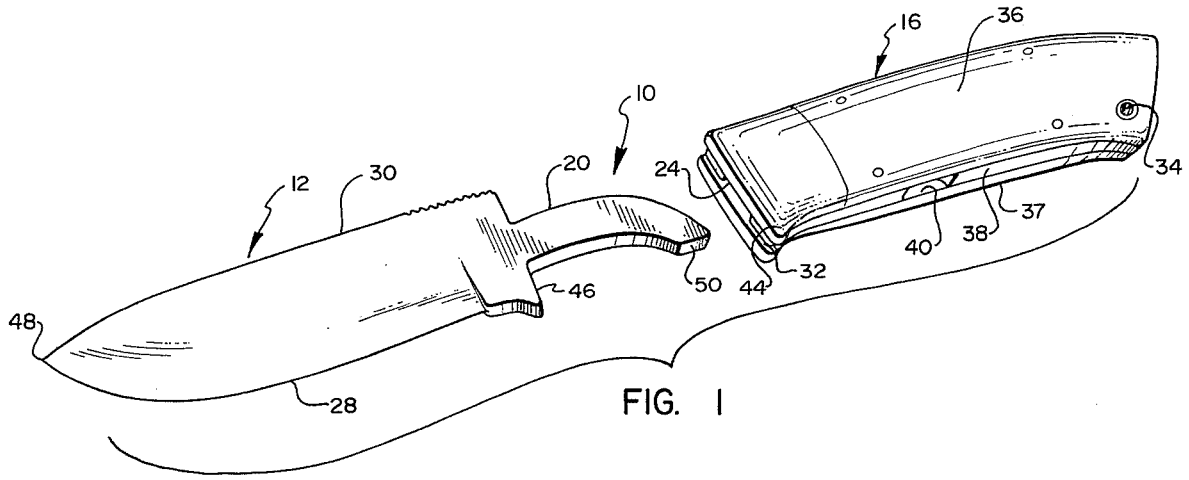
FIG. 1 is an exploded perspective of the knife embodiment of this invention.

Referring now more particularly to FIG. 1, the knife of this invention is shown generally at 10 and includes a removable blade 12 and a handle 16. Blade 12 includes a cutting edge 28, a back 30, a base 46 and a tip 48. Extending rearwardly from base 46 is a curved tang 20 with the arc of the curve bending toward the cutting edge 28 and terminating in a flat surface 50.

Handle 16 includes a top hand piece 36 and a lower hand piece 37 enclosing in sandwich relationship a shank 38. In conventional knives, shank 38 is an extension of blade 12. However, in the present embodiment, shank 38 includes an arcuate slot 24 therethrough terminating in an opening 40 in the edge of handle 16. Placement of tang 20 in slot 24 engages the blade 12 with handle 16 with the flat end 50 of tang 20 closing slot opening 40 to thereby provide a smooth exterior configuration to that portion of handle 16.

Tang 20 is also, preferentially tapered along its curvature so as to progressively frictionally engage the walls of slot 24 when inserted therein. Curvature of tang 20 also causes working forces exerted against the cutting edge 28 of blade 12 to force tang 20 deeper and, therefore, more securely into slot 24.

Base 46 of blade 12 is received within a keyway 32 which extends along the forward end of handle 16 including finger guard 44. Keyway 32 assists in securing the base 46 of blade 12 against lateral movement from forces imposed on the side of blade 12.

Handle 16 selectively includes a conventional lanyard receiving hole 34 to serve as a means for tethering the knife 10 as desired by the user.

THE EMBODIMENT OF FIGS. 2 AND 3

Figure 2:
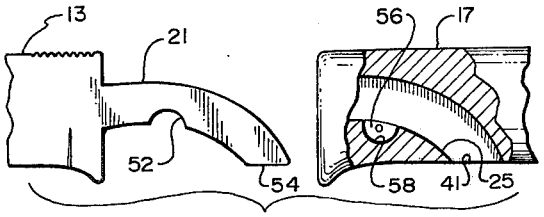
FIGS. 2—3 represent a side elevation of one locking embodiment of this invention.
Figure 3:
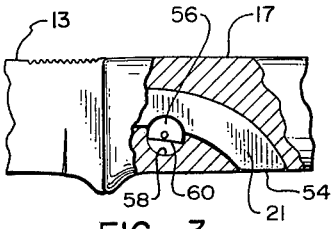
Figure 4:
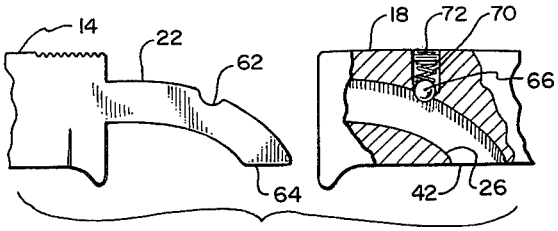
FIGS. 4–5 represent another locking embodiment for this invention.
Figure 5:
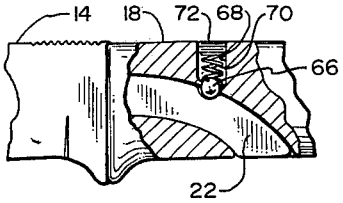

Referring now more particularly to FIGS. 2 and 3, a knife blade 13 has extending therefrom an integral tang 21 having a notch 52 in a side thereof. The end of tang 21 terminates in a flat surface 54 for the purposes as set forth hereinabove with respect to flat surface 50 of tang 20 (FIG. 1).

Handle 17 includes an arcuate slot dimensionally corresponding to the arcuate tang 21 and terminating in an opening 41 comparable to opening 40 in handle 16 (FIG. 1). Adjacent one side of slot 25 and specifically coinciding with notch 52 is a semicylindrical locking member 56 which is rotatably operable in an opening 58 in handle 17.

Locking member 56 includes a flat surface 60 along one edge thereof for the purpose of permitting the insertion of tang 21 into slot 25. Rotation of locking member 56 to the position shown in FIG. 3 moves the cylindrical surface of locking member 56 into the notch 52 to thereby securely engage tang 21 into slot 25 and, accordingly, handle 17.

Locking member 56 is, selectively, provided with an offset pivot to thereby impart a cam action to its movement upon rotation. Preferentially, the cam action forces tang 21 deeper into slot 25 to provide a more secure engagement between blade 13 and handle 17.

Rotation of locking member 56 is readily accomplished from the exterior of handle 17 by any number of suitable conventional devices including, for example, a slotted opening, a raised ridge, etc. Preferentially, the conventional rotation means should be finger actuable in order to remove the requirement for additional tools and replace the blade 13 from the handle 17.

With particular reference to FIG. 3, it should be noted that the flat end 54 of tang 21 extends to the edge of handle 17 thereby providing a smooth contoured surface to that portion of handle 17.

THE EMBODIMENT OF FIGS. 4 AND 5

In this other presently preferred embodiment for the knife of this invention, a blade 14 has extending therefrom as an integral member an arcuate tang 22 with a notch 62 formed in one side thereof and terminating in a flat surface 64. Handle 18 includes an arcuate slot 26 terminating in an opening 42. Extending into slot 26 is a detent 66 which dimensionally corresponds with the placement of notch 62 when tang 22 is inserted in slot 26. Detent 66 is held in a cylindrical hole 68 in handle 18 and is held under compression by a spring 70 which is compressed by a recessed set screw 72.

Insertion of tang 22 into slot 26 causes the leading edge of tang 22 to force detent 66 against spring 70 to permit the complete insertion of the tang 22 into slot 26 whereupon the spring 70 forces the detent 66 to be engaged in notch 62 thereby releasably interlocking the tang 22 in slot 26 and, accordingly, handle 18.

Removal of blade 14 from handle 18 is readily accomplished by exerting a force on the edge opposite the cutting edge of blade 14 thereby causing the detent to disengage from notch 62 and permit the removal of tang 22 from slot 26.

THE EMBODIMENT OF FIGS. 6-8

In this other presently preferred embodiment of this invention, a blade 15 includes an integral arcuate tang 23 having a notch 74 in one side thereof adjacent the flat end 76.

Figure 6:
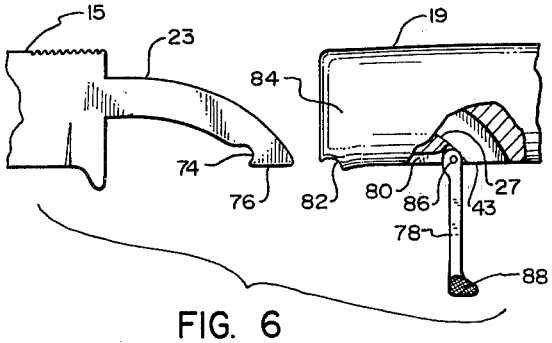
FIGS. 6–7 represent another locking embodiment for this invention.

Handle 19 for blade 15 includes an arcuate slot 27 dimensionally corresponding with arcuate tang 23 and terminating in an opening 43 in the side of handle 19. Extending forwardly from opening 43 is a lever receiving slot for cam lever 78. Lever slot 80 terminates in a transverse notch 82 in finger guard 84 at the forward end of handle 19. As shown in FIG. 6, lever 78 is pivoted downwardly about a pivot 86 so as to permit the insertion of tang 23 in slot 27.

Figure 7:
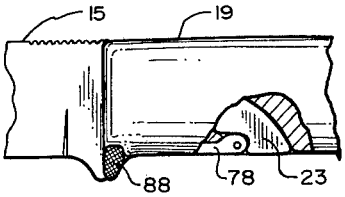

Referring now more particularly to FIG. 7, tang 23 is inserted into slot 27 in handle 19, and lever 78 is rotated upwardly into lever slot 80. The knurled finger gripping portions 88 of lever 78 reside in transverse notch 82 so as to present a smooth profile as between finger guard 84 of handle 19 and knurled portions 88 and 89 of lever 78. Lever 78 pivots about an eccentric pivot point 86 to thereby provide a cam surface 92 which imparts a cam action to notch 74 when lever 78 is rotated upwardly into its locked position in handle 19. The cam action of lever 78 progressively tightens the tang 23 in slot 27 upon engagement of lever 78 and, more particularly, cam surface 92 with notch 74.

Figure 8:
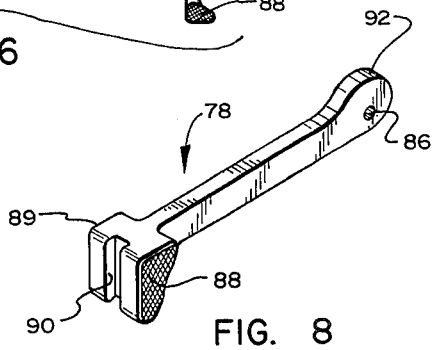
FIG. 8 is an enlarged perspective of the locking lever of the locking embodiment of FIGS. 6 and 7.

Referring now more particularly to FIG. 8, lever 78 includes a keyway 90 between knurled finger gripping portions 88 and 89 which keyway corresponds with the leading edge keyway (not shown) of handle 19 and which is comparable to keyway 32 of handle 16 (FIG. 1). In this manner, keyway 90 assists the keyway (not shown) in handle 19 in supporting the base of blade 15 engaged therein.

THE METHOD

The method of this invention includes obtaining at least one blade which may be selected from any one of a plurality of blade configurations including, for example, a skinning blade, a chopping blade, a linoleum blade, a prunning blade, a hatchet blade, a saw blade, a fisherman's blade, a tool blade, and the like, and forming at the base thereof an integral, arcuate tang. The curvature of the arcuate tang is toward the working edge of the blade whether it be a saw, cutting blade, hatchet, or the like. In this manner the imposition of normal working pressures on the blade cause the arcuate tang to be forced deeper into the tang receiving slot in the handle. Selectively, the tang may include various notch means therein for the purpose of releasably interlocking the tang with the handle and may also be tapered toward its end so as to additionally provide a frictional interlock of the tang with the handle as may be visualized from the embodiment of FIG. 1.

The method of this invention also includes fabricating a handle for the particular blade embodiment wherein the handle includes a dimensionally corresponding arcuate slot therein for receiving in mating relationship the arcuate tang of the blade. The handle also, selectively, includes means for releasably locking the tang in the handle which may include, among others, a semicylindrical rotatable lock, a cam, a detent, a cam lever and/or a tapered, arcuate tang receiving slot to telescopically mate with a dimensionally corresponding tang.

Since the tang receiving slot is susceptible to having dirt and other debris collect therein, it is also desirable that the arcuate slot extend from the forward end of the handle through an adjacent edge so as to have a slot with both ends open since the accumulation of debris in the base of a slot would inhibit the full insertion of the tang therein. With the open ended slot shown herein dirt or other debris that would otherwise tend to accumulate within the slot would be forced therefrom by repeated insertion of the tang.

Removal of the blade for the purpose of replacing it with another blade configuration is readily accomplished by, where applicable, unlocking the locking member and exerting a force on the rear edge of the blade to arcuately remove the tang from the slot in the handle. This can be accomplished safely since the rear edge of the blade is usually a noncutting edge and generally, may be safely grasped by the user.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A knife accommodating interchangeable blades comprising:

a handle for a blade, the handle comprising:

a hand gripping portion having a keyway at the forward end of the handle, the keyway receiving the base of the blade; and an arcuate slot for receiving a dimensionally corresponding arcuate tang, the slot having a forward opening in the keyway at the forward end of the handle and extending through the handle to a side opening in the side of the handle, the arcuate slot curving toward the side of the handle corresponding to the working edge of the blade, the side opening permitting debris in the slot to be forced therefrom by the tang; and a blade comprising a working edge and having an arcuate tang extending from the base of the blade, the tang curving toward the working edge of the blade and being dimensionally configurated to be received in the slot in the handle, the base of the blade being received in the keyway.

2. A knife as defined in claim 1 wherein the arcuate tang received slot in the handle extends from the end of the handle to an opening at the side of the handle and includes a detent adapted to dimensionally correspond with a notch in the tang, the detent cooperating in the notch to releasably interlock the tang in the slot.

3. A knife as defined in claim 1 wherein the slot includes locking means for releasably interlocking the tang in the slot, the locking means comprising a rotatable, semicylindrical locking member operable in an opening adjacent the slot, the locking member having a flat side to permit insertion and removal of the tang in the slot, the semicylindrical surface being rotatable into mating configuration with a dimensionally corresponding notch in the tang.

4. A knife as defined in claim 1 wherein the handle includes means for releasably interlocking the tank in the handle comprising a frictional restraint between the tang and the slot developed as a result of the corresponding dimensional relationship of the slot with the tang, the curvature of tang accommodating the imposition of normal working forces against the working edge of the blade to force the blade deeper into the slot thereby more tightly and frictionally interlocking the tang with the slot and, therefore, the handle.

5. A knife as defined in claim 1 wherein the handle includes means for releasably interlocking the tang in the handle comprising a locking cam which forces the tang deeper into the slot when the cam is moved to its locking configuration, the locking cam being on the end of a cam lever, the cam lever nesting within a lever slot when closed and having finger gripping portions at the end opposite the locking cam, the finger gripping portions forming a part of the finger guard of the handle in a smooth profile therewith.

6. A knife accommodating interchangeable blades comprising:

a handle for the knife, the handle further comprising:

an arcuate tang-receiving slot extending through the handle between an opening in one end and the side of the handle which corresponds to the working edge of the blade; and means for releasably engaging the tang in the slot; and a blade for the knife comprising:

a blade having a working edge and a base at one end; and an arcuate tang extending from the base of the blade, the tang being arcuate and dimensionally configurated to be telescopically received in the slot, the curvature of the tang being toward the working edge of the blade and accommodating being forced deeper into the slot by normal working forces exerted on the working edge of the blade.

7. A knife accommodating interchangeable blades comprising:

a hand gripping handle portion having an arcuate tang receiving slot extending through the handle from one end of the handle to a side of the handle adjacent the working edge of a blade and engaging means for releasably engaging a tang in the slot; and a blade having an arcuate tang extending from the base of the blade, the tang being dimensionally configurated to be telescopically received in the slot in the handle, the end of the tang closing the slot opening in the side of the handle, the tang having a notch for receiving the engaging means.

8. A method for providing an interchangeable blade combination for a knife comprising the steps of:

obtaining a handle having a hand gripping portion and forming a tang receiving slot between a first opening in one end of the handle and a second opening in a side of the handle, the slot having an arcuate configuration dimensionally corresponding to a tang of a blade placed on the handle, the handle having locking means in the handle for releasably engaging the tang in the handle;

preparing a blade for the handle by forming a tang on the blade, the tang having an arcuate curve toward the working edge of the blade, the tang being dimensionally configurated to be telescopically received in the slot in the handle;

removing the blade from the handle by unlocking the locking means and exerting a force on the blade reverse to the normal working forces exerted on the blade to arcuately remove the tang from the slot;

forcing debris accumulation from the slot through the second opening by replacing the blade with a second blade and arcuately inserting the second tang in the slot thereby forcing debris therefrom;

locking the tang in the handle; and forcing the tang deeper into the slot by exerting working forces on the working edge of the blade.

9. A knife comprising:

a handle comprising a hand gripping portion having an arcuate slot extending from a first opening in one end of the handle and terminating in a second opening on an edge of the handle, the edge of the handle corresponding to a working edge of a blade attached to the handle, the slot opening at the end of the handle into a keyway extending transverse to the slot, the keyway receiving the base of a blade; and a blade comprising a base and a working edge, the base having an arcuate tang extending away from the blade with the curvature of the arcuate tang being toward the working edge of the blade, the base of the blade being received in the keyway when the arcuate tang is telescopically received in the arcuate slot, the end of the tang closing the second opening on the edge of the handle, the arcuate tang being forced more tightly into the slot by normal working forces exerted on the working edge of the blade.

* * * * *